United States Patent [19]

Wehmeyer

[11] Patent Number: 4,532,410

[45] Date of Patent: Jul. 30, 1985

[54] LOW VOLTAGE BATTERY OPERATED HEATING BIB

[76] Inventor: Betty A. Wehmeyer, P.O. Box 118, Ingram, Tex. 78025

[21] Appl. No.: 531,407

[22] Filed: Sep. 12, 1983

[51] Int. Cl.[3] ..... H05B 3/34

[52] U.S. Cl. ..... 219/211; 219/529; 219/549; 219/527

[58] Field of Search ..... 219/211, 527, 528, 529, 219/548, 549; 128/379–384, 402; 2/2.1 A

[56] References Cited

U.S. PATENT DOCUMENTS

| | | | |
|---|---|---|---|
| 2,048,880 | 7/1936 | Morgan | 219/528 |
| 2,082,468 | 6/1937 | Pupier | 219/211 |
| 2,432,159 | 12/1947 | Hyre | 219/527 |
| 3,293,405 | 12/1966 | Costanzo | 219/211 |
| 3,392,264 | 7/1968 | Arron | 219/211 |
| 3,396,264 | 8/1968 | Murphy | 219/211 |
| 3,500,014 | 3/1970 | Longo | 219/211 |
| 3,839,621 | 10/1974 | Hariu | 219/211 |

FOREIGN PATENT DOCUMENTS

| | | | |
|---|---|---|---|
| 498218 | 1/1920 | France | 219/211 |

*Primary Examiner*—Roy N. Envall, Jr.
*Assistant Examiner*—Teresa J. Walberg

[57] ABSTRACT

A low voltage battery operated heating bib containing a low voltage heater connected in circuit with a low voltage battery concealed in a neck scarf to which the bib is attached and made an integral part.

4 Claims, 7 Drawing Figures

LOW VOLTAGE BATTERY OPERATED HEATING BIB

BACKGROUND OF THE INVENTION

1. Field of the Invention

This invention relates to a long-sought means of providing a feeling of warmth to the entire human body for comfort and protection in active outdoor pursuits in cold environments by means of conventional, convenient, practical and desireable materials, such as a neck scarf, to which an appendage or bib is attached and made an integral part and in which is disposed a heater which may consist of a strip or strips of electrical resistance material connected by insulated conductors to a low-voltage power source, or a heater of chemical substance which is easily portable either in the bib or in the scarf.

2. Description of the Prior Art

Since man first wore garments to insulate him from the cold, a simple means of warming the human body in active pursuits in cold weather without the addition of cumbersome and restrictive protective clothing has been sought. The advent of a portable, nickel-cadmium-alkaline cell battery, patented by Ernst Jungner of Germany in 1899 and improved in 1935 for commercial production, has given rise to many efforts at warming specific parts of the human body by many skilled in the ordinary arts of electricity or apparel, some of which have met a small part of ever-increasing demands for protection from the cold in outdoor activities of all sorts. For example: Longo disclosed in U.S. Pat. No. 3,500,014 a means of heating the legs or the neck with a small heating element, either in a blanket in the former or a scarf in the latter. A small heating element in a blanket may warm only parts of the legs and a small heating element in a scarf will warm the back of the neck alone.

Constanzo taught in U.S. Pat. No. 3,293,405 that a small heating unit may warm the toes of the feet and Arron in U.S. Pat. Nos. 3,392,264 and 3,524,965, sought to make improvements on heating the toes of the feet but both patents were declared invalid (187 USPQ257). Yet, each taught only a means and modification by which only the toes might be warmed.

Winchell, in U.S. Pat. No. 3,079,486, taught a sock which also only heated the foot; and Corona, in U.S. Pat. No. 3,084,241, disclosed a heated vest which, though impractical of portable power, still only warmed a part of the chest and back. Doron, in U.S. Pat. No. 2,809,375, disclosed an ascot scarf, without heating element, with a dickey or bib-like extension which draped over the shoulders and chest and a back panel which fell over the upper portion of the back. Doron taught that his invention would assist in protecting the upper part of the body from penetration of cold, although he taught nothing about warming the body.

In each of the herein-before-cited inventions, the devices were designed to be worn under protective garments normally employed in keeping the human body warm in cold environments.

However, despite the foregoing and other obvious applications of portable, electrical heat to specific parts of the body, i.e., the hands, the feet, the neck, etc., a person actively working or playing in a cold environment has, until this invention, remained feeling cold on other parts of the body than those to which electric heating has been directly applied.

Medical arts have long taught the application of heat for specific bodily parts and even to specific parts of the body to cause general warmth, general well-being or therapy using, primarily, electrical current supplied by stationary sources to which a patient must be secured and therefor constrained from active pursuit of enterprise or enjoyment; however, little, if anything, significant has been taught by the medical arts for heating parts of ambulatory patients and nothing has been taught by the medical arts by way of heating active and ambulatory bodies with electricity.

Thus, numerous technicians with ordinary skills in the arts pertaining to warming the human body, over a substantial period of time and notwithstanding the availability of the necessary materials, have failed to percive a most desireable, long-felt and unsolved need for an otherwise easily achievable goal which is a surprising and unusual innovation, immediately recognized by the outdoor consumer as being of great benefit, comfort and practicality.

SUMMARY OF THE INVENTION

The inventor, having showered in hot water showers on cold mornings for many years, recognized, as may have others, that the human body remains chilled except where the hot water is directed despite the heat of the shower water, unless and until the body is turned so that the hot water is directed only on the posterior portion of the Cervical Plexus, at the approximate junction of the first and second thoracic vertebrae (between the shoulders and just below the base of the neck). When hot water from the shower is directed on the posterior portion of the Cervical Plexus, the bather feels warm all over his body.

Recognition of this natural phenomenon encouraged us to experiment with known and available materials for applying and maintaining heat to the posterior Cervical Plexus in wearing apparel in order to provide warmth to the entire body in cold-weather pursuits in the out-of-doors.

Thus, the present invention relates to and is the outgrowth of research, development and testing of devices with the object of providing a feeling of overall warmth to the human body in active, mobile pursuits in cold environments. The resultant invention embodies conventional, state-of-the-art materials in combination to produce an innovative device which can supply heat by means of a chemical heater or by means of electrical current from a low-voltage dry-cell battery of a size that is easily portable and inconspicuously and safely attached by insulated conductor wires to a resistance-wire heater, which can be placed and maintained effectively, safely, economically and functionally over a small portion of the human body to provide the wearer with a feeling of warmth over the entire body.

It is apparent from the foregoing that many modifications and changes are possible without departing from the spirit and scope of the present invention.

DESCRIPTION OF THE PREFERRED EMBODIMENTS

Figure 1:
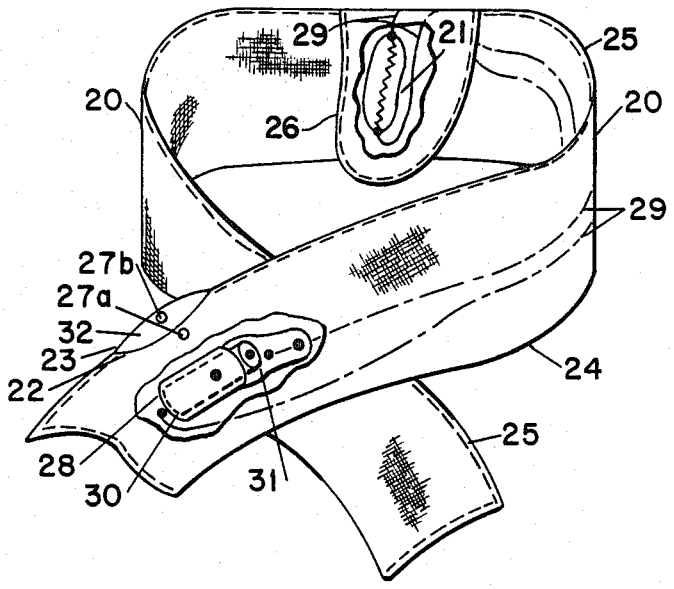
FIG. 1 is a front plan view of an assembled heating device comprised of a scarf with a bib constructed in accordance with this invention, having portions thereof broken away.

Referring to the drawings, there is illustrated in FIG. 1 a heating scarf construction 20 embodying the present invention which, for purposes of illustration only, is shown in the form of a neck scarf. However, it will be understood that the present invention can be embodied in any type of apparel to which a bib or appendage containing a heater element 21 may be disposed to maintain direct contact with the body's posterior Cervical Plexus in order to give the entire human body a feeling of warmth under cold-weather apparel.

The illustrated scarf 20 therefore comprises a front portion 23 and a back portion 22 which, when folded along the center fold line 24 and sewn together by a seam 25, forms a conventional neck scarf which can be worn inside or outside the wearer's conventional outdoor apparel in a conventional manner. The scarf portions may be formed of any desireable material which provides warmth and comfort to the wearer. The folded scarf is rectangular in shape with the length between the longitudinal ends being greater than the width between the center fold line 24 and the lateral edges adjacent to the sewn seams 25.

An auxillary source of heat 21, which will be hereinafter described, is located in a bib 26 which is so constructed as to be an integral part of the scarf 20 and is appended to the scarf so that it may be disposed between the front portion 23 of the scarf 22 and the skin covering the posterior Cervical Plexus of the wearer, allowing the wearer to enjoy the auxillary source of heat while at the same time providing the wearer with complete freedom of movement in conventional and functional apparel. The bib may be secured to the scarf at right angles to the longitudinal length of the scarf and midway between the ends of the scarf. The bib 26 is constructed in the shape of an ellipse for easy insertion and in order to easily maintain its position under exterior garments of the wearer; however, it will be understood that any shape will be suitable for the bib, which allows for easy placement in position inside the wearer's outer garments and against the skin of the wearer and which provides for the disposing of the heater element 21 so that it is in direct contact and maintains direct contact with the body's posterior Cervical Plexus.

Wire conductors 29, utilized for conducting electrical energy to the heater element 21, are extended from the heater element 21 through the interior of the folds of the scarf 20 to a pocket 28 for receiving a power source. Wire conductors 29 may be secured to the interior of the front portion of the scarf 23 but it has been found that disposing the wire conductors within the interior of the folds of the scarf 20 without securing them to the fabric of the scarf yields greater flexibility to the scarf and greater comfort to the wearer, while at the same time providing concealment of the wire conductors 29 and thus a better appearance as well as less encumbrance to the wearer.

A pocket 28, as will be herein described, for receiving an electrical power source 31 is preferably secured by sewn seams 30 to the interior of the front portion 23 of the scarf 20 near one end of the scarf 20 so that the weight of a power source contained therein is rendered practically unnoticeable to the wearer and provides for a minimum of interference with other wearing apparel. It will also be recognized that by disposing the power source 31 in pocket 28 near one end of the scarf 20, danger of harm to the wearer by falling with the power source against the body is practically eliminated.

An aperture 32 is defined in the sewn seams 25 of the scarf blank 22 which may be secured by suitable fasteners 27A and 27B e.g., snap fasteners, which permits access to the pocket 28 for emplacement, engagement or removal of the power source 31.

Figure 2:
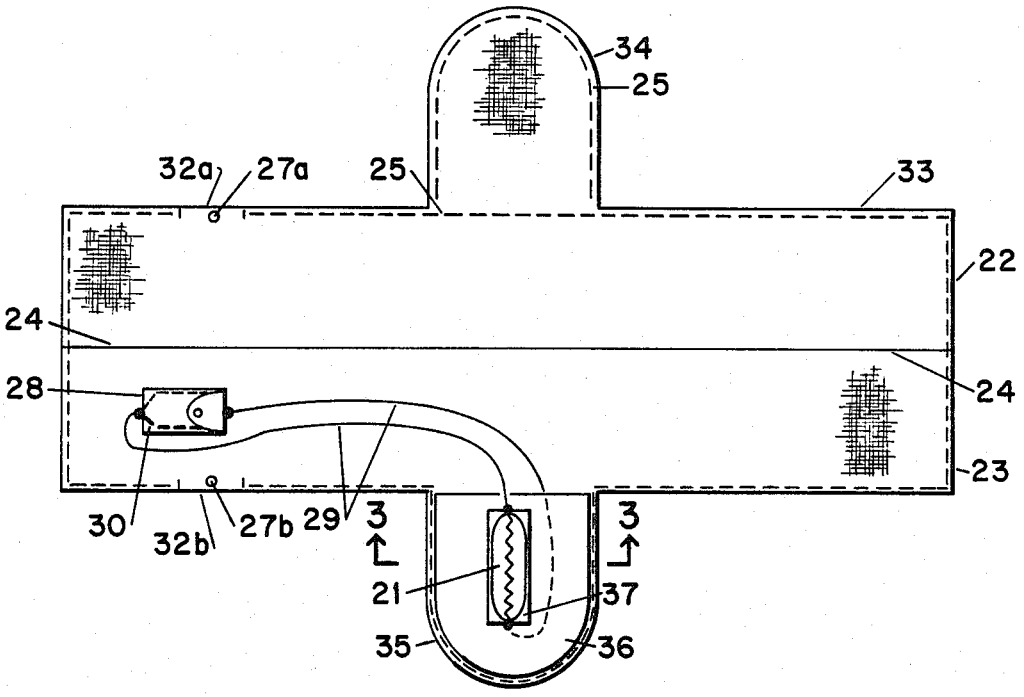
FIG. 2 is a plan view of the inside portions of a neck scarf blank to which the inside portions of bib blanks have been defined and attached and which illustrates the position of the heater means and conducting wires on the inside portions of the scarf and the bib, and the position of a pocket for receiving a battery.

Referring to FIG. 2 there is illustrated an interior plan view of a scarf blank 33 which is constructed so as to be substantially rectangular, to which the front 35 and back 34 portions of the bib 26 FIG. 1 have been secured and made an integral part. The scarf blank may be constructed of any fabric suitable for making a scarf to be worn around the neck of a wearer, such as woven synthetics, silk or woolens. In the application of the scarf fabric to this invention, it has been found that a blend of natural and synthetic fibers is superior in that such a fabric is washable, comfortable and pleasing in appearance. It will be understood that the front portion of the bib 35 may be cut from the same fabric as the scarf 33; however, the back portion of the bib 34 is preferably constructed of a different fabric than the scarf blank 33 in order to provide characteristics of heat conduction, absorption and softness against the wearer's skin with which the back portion of the bib 34 comes in direct contact. Many fabrics are suitable for construction of the back portion of the bib 34 but simple, woven cotton fabric has been found to be superior in its application to this invention; however, strength and resistance to abrasion may be improved by using polyester or polyamide (35% to 65%) blends with cotton. The front portion of the bib 35 may be cut as a part of the scarf blank 33 or may be cut separately and secured to the scarf blank by a suitable means such as a sewn seam 25. The back portion of the bib 34 is suitably secured to the scarf blank by fusing or adhesion or by a sewn seam 25, as illustrated herein.

In the illustrated embodiment, the heater element 21, as will be described herein, is disposed upon the interior surface of the front portion of the bib 35. The heater element 21 is preferably disposed on the front portion of the bib 35 perpendicular relative to the longer dimension of the scarf blank 33 and in alignment with the longer dimension of the front portion of the bib 35. The placement of the heater element 21 in this position allows greater exposure of the heater element to diverse size wearers so that the warming of the wearer's posterior Cervical Plexus is assured by contact with the heater element 21; however, it has also been found that the heater element 21 may be disposed in other positions in the bib 26 FIG.1 and provide the wearer with sufficient warmth, such as transversely to the longer dimension of the bib 26 FIG. 1.

Figure 3:
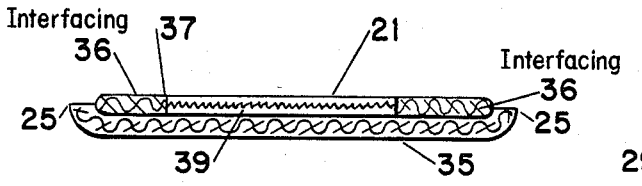
FIG. 3 is a detailed cross-sectional view of the bib construction taken along line 3—3 on FIG. 2.

As shown in FIGS. 2 and 3, the heater element 21 is preferably secured to the front portion of the bib 35 since when the two bib portions are joined by a sewn seam 25, the fabric of the front portion of the bib 35, which is the same as the fabric of the scarf blank 33, will retain the warmth from the heater element 21 and encourage the radiation of warmth from the heater element 21 through the more conductive fabric of the back portion of the bib 34. The heater element 21 and its electrical conductor wires 29 may be secured to the front portion of the bib 35 by means of a sewn seam or by adhesion; however, it has been found that construction of the bib 26 FIG. 1 is considerably improved when the heater element 21 and its electrical conductor wires 29 are secured to the front portion of the bib 35 with an iron-on interfacing of polymerized, synthetic fabric 36 such as a non-woven, polyester or other synthetic polymeric fabric iron-on, as described on pages 115–124 of "America's Sewing Book" by Sandra Ley, published by Charles Scribner's Sons, 1972, Library of Congress Card Number 72–1207. These non-woven fabrics comprise two major components—the web and the binder. While the basic fiber may be treated with a resin-binding material, the use of a thermoplastic fiber with a lower melting point than the base fiber is a common way of forming a web. The web may either be calendered or embossed at the softening point of the fiber having the lower melting point, which causes bonding to take place. Generally the bonding agent will constitute from 10 percent to 30 percent by weight of the finished fiber. Such materials using polyamides and triacetate fiber have relatively high sticking and melting points with suitable electrical properties. The use of triacetate press covers is well known in the textile art.

By using an iron-on interfacing 36 in the construction of the bib 26 FIG. 1, considerable sewing and danger to fragile portions of the heater element 21 are eliminated.

A significant advantage of the employment of a fusible, non-woven polyester, polyamide or other "iron on" synthetic material, is that it provides additional strength and rigidity to the bib 26 FIG. 1 which is required to provide the wearer with ease of insertion between his outer garments and his posterior Cervical Plexus and, in particular, to retain the bib in place once it has been inserted. It will be realized that maintaining the bib in stable contact with the wearer's posterior Cervical Plexus is critical to this invention. Another advantage obtained by securing the heater element 21 to the front position of the bib 35 with iron-on interfacing is the interfacing's compatability in weight and washability with the fabric of the front portion of the bib 35 and the back portion of the bib 34 so that shrinking and stretching are reduced to a minimum when the two portions of the bib are sewn together. In the construction of the iron-on interfacing 36, a window, 37 or aperature is constructed in the blank of the iron-on interfacing which permits the heating portion of the heater element 21 to come directly in contact with the heat conductive fabric of the back portion of the bib 34 so that no heat loss will occur which might otherwise be occasioned if the fabric of the iron-on interfacing were placed over the heater element itself. It will be understood that the aperature in the iron-on interfacing would ordinarily extend from the edge of the interfacing which is in proximate contact with the scarf and in the center of the interfacing to a point in the interfacing which would coincide with the lower edge of the wearer's Cervical Plexus. Accordingly the aperature serves as a channel along which the resistance heater element is positioned. The fabric insulation may be adhesively bonded to opposing edges of the aperature 37 as a further means of stabilizing the heating element in the bib.

A pocket 28 pre-constructed, as will be described herein, is secured to the interior of the front portion of the scarf blank 23 near one of the longitudinal ends of the front portion of the scarf blank 23 by a sewn seam or adhesion. Electrical conductor wires 29 from the pocket 28 to the front portion of the bib 35 remain unsecured to provide greater flexibility of the finished garment when the scarf 20 is completely assembled as in FIG. 1.

Referring to FIG. 2, the assembled scarf 20, as seen in FIG. 1, is formed by folding the scarf blank 33 along fold line 24 so that the back portions of the bib 34 and the scarf blank 22 are truly aligned with the front portions of the bib 35 and the scarf blank 23 to form a conventional scarf with an appendage. When folded together, the exterior edges of the first and second longitudinal portions and the exterior edges of the first and second end portions of the joined blanks are secured by a sewn seam 25 with the exception of an aperture 32 in the sewn seam 25 which permits access to the pocket 28, said aperture 32 being possible of securement by suitable fastener 27A, such as a snap fastener, which is arranged to mate with a complimentary fastener 27B.

Figure 4:
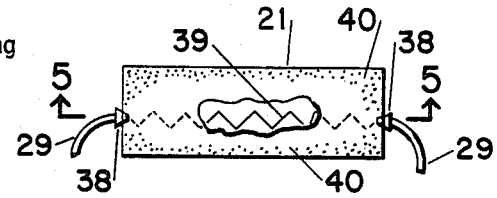
FIG. 4 is a detailed plan view of the heater means, having a portion thereof broken away.
Figure 5:
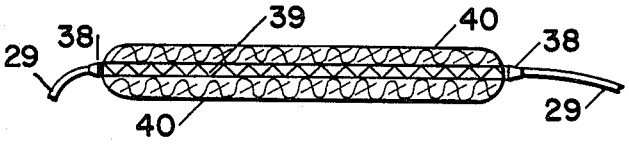
FIG. 5 is a cross-sectional view of the heater means taken along line 5—5 on FIG. 4.

Referring to FIGS. 4 and 5, the heater element construction 21 comprises a strip of bare, flat resistor element 39, such as Nichrome or another suitable resistance material known in the art, is capable of being energized by an electrical power source such as a low voltage battery source. A flat strip of Nichrome approximately 6 inches long by 0.210 inches wide and 0.002 inches thick has been found satisfactory. However, it will be understood that the foregoing heater specifications are not critical as the dimension of the element may be varied depending on the resistance characteristic desired of a particular resistor element. The ends of the resistor element 39 are connected to the ends of the associated conductor wires 29—29 by crimp connectors 38—38 providing positive mechanical connections between the ends of the resistor element 39 and the respective conductor wires 29—29. Thus, a positive mechanical bond and electrical connection is assured between the ends of the resistor element 39 and the corresponding ends of the connected wire conductors 29—29 to provide for trouble free operation throughout the life of the heated scarf. The resistor element 39 is sandwiched between opposed strips of a heat diffusible material 40 which forms a covering for the element 39. The covering or sandwiching strips 40—40 in addition to functioning as a heat diffuser or conductor, as will be hereinafter described, function to maintain the shape of the resistor and to prohibit the relatively fragile resistor from breaking. Preferably, the strips of sandwiching material 40—40, are coated on one side with a suitable adhesive so that they can be readily secured in back to back relationship to sandwich the resistor element 39 therebetween in heat transfer relationship therewith. It will be understood that any suitable material may be utilized as the heat diffusing, sandwiching or covering material for the resistor element. In the illustrated form of the invention the heat diffusion covering or sandwiching material 40—40 comprises triacetate tape coated on one side with a thermal setting adhesive to facilitate the securing of the resistor element thereto. The heat diffusion covering or material 40—40 may comprise any suitable material which will permit the heat generated by the resistor element to be conducted or radiated therethrough in an amount which will not burn or otherwise harm the wearer. Other suitable covering material may comprise of metallic foil, fiberglass, and thin asbestos sheets that will permit heat to be conducted and radiated therethrough and be diffused in an amount which prohibits the formation of excessive hot spots which may otherwise burn or injure the wearer.

Figure 6:
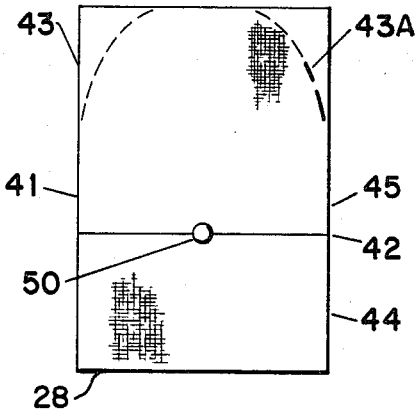
FIG. 6 is a plan view of the pocket blank.
Figure 7:
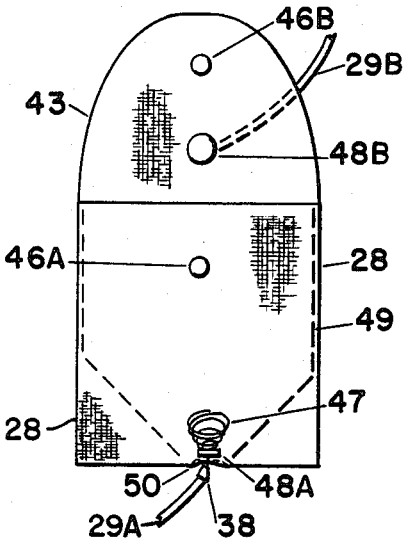
FIG. 7 is a detailed plan view of the pocket and the electrical connector means.

Referring to FIGS. 6 and 7, the pocket 28-FIGS. 1 and 2 is preferably constructed of a blank of sheet material 41 so arranged that when folded along fold line 42 and cut along cut line 43A, it will define a pocket 28 FIGS. 1 and 2 which will snuggly receive a low voltage battery 31 FIG. 1. The battery 31 in FIG. 1 for energizing the heater comprises a flashlight type battery having a voltage capacity of approximately one and one-half (½) volts which may be either a standard dry cell flashlight battery, an alkaline battery, a nickel cadmium battery or any other battery of low voltage capacity. The pocket blank 41 is constructed in a generally rectangular shape to define a front portion 44, a back portion 45, and a flap 43. The flap 43 is defined by cutting the blank 41 along the cut line 43A. The pocket blank may be constructed from any generally flexible material having good dimensional stability. A wide variety of woven and non-woven fabrics are suitable. It may also be made of a flexible polymeric sheeting having good electrical insulation resistance under changes in frequency and temperature and good folding endurance over the temperature range to be expected during usage and storage (between about −30 degrees F. and 130 degrees F.). Polyesters formed by the condensation of terephthalic or isoterephthalic acid or other aromatic dibasic acids and ethylene glycol or 1, 4 cyclohexane dimethanol are examples of suitable and conventional polyester materials. Polyester sheeting may be coated with polyvinyl chloride as a means of improving heat sealability. Plasticized polyvinyl chloride, co-polymers of vinyl chloride and vinyl acetate as well as various nylon sheetings are also useful. (Polyamides produced by the condensation of a diamine such as hexamethylene diamine with a polycarboxylic acid such as adipic or sebacic acid.) Nylon 6 is produced from aminocaproic acid lactan which contains a seven-membered ring which is converted into a linear polymer by heating with a trace of water to make an acceptable sheet material. The technology and application of these and other suitable polymeric sheeting materials is well known in the art and is disclosed in the 1982–1983 Modern Plastics Encyclopedia. However, it has been found that a synthetic knitted fabric such as a double knit is superior in its application to this invention since it is soft and pliable in a cold environment within the finished scarf while still possessing sufficient strength to retain the battery when inserted for heating the scarf. When folded along the fold line 42 so that the front portion 44 is directly opposed to the back portion 45 the two portions may be joined by a sewn seam 49 or by adhesion as indicated in FIG. 7 to define therebetween a pocket volume sized to snuggly receive a battery 31 FIG. 1.

A contact plate, 48A of electrically conducting material is located in the bottom of the pocket 28 and it is electrically connected to the conductor wire 29A through the aperature 51. The contact plate 48A is adapted to make electrical contact with one of the battery electrodes when the battery is connected in circuit to the heater 21 FIG. 1. A spring 47 is connected to the contact plate 48A to keep the battery 31 FIG. 1 snuggly against both electrical contacts when the heater is energized.

The upper portion of the blank 41 defines a flap 43 which is adapted to be folded over the end of the battery contained within the pocket to secure the battery therein. As shown, an intermediate portion of the flap 43 is provided with an electrical contact button 48B which is arranged to engage the other electrode on top of the battery 31 FIG. 1 to complete the electrical circuit to the heater whenever the flap 43 is closed. Contact button 48B is connected in circuit to the heater by the other conductor wire 29B. It will thus be noted that when flap 43 of the pocket is closed with the contact plate 48A and the contact button 48B to complete the circuit to the battery. The flap thus functions as a switch means by which the battery is connected into and out of circuit with the resistor elements, i.e., the circuit to the heater is open when the flap is open and the circuit energized when the flap is closed. To positively secure the flap 43 in the closed position, a suitable fastener 46B, e.g., a snap fastener, is connected to the flap 43 which is arranged to mate with a complimentary fastener 46A located on the front portion of the pocket 28.

From the foregoing description, it will be apparant that the scarf may be worn either as a conventional scarf or as a heated scarf when a battery is secured within the battery pocket and connects in electrical circuit with the heater. The arrangement of the pocket 28 near the end of the scarf 20 FIG. 1, and accessible through the aperture 32 FIG. 1 in the interior folds of the scarf 22 and 23 FIG. 1, renders its presence substantially negligible, provides safety and attractive appearance to its wearer and renders it free from interference from other articles of clothing which may be worn by the wearer. Also the heater construction 21 is such that it can be readily secured to the bib construction 26 by the use of an iron-on interfacing 36 thus eliminating costly sewing steps, providing protection to the fragile portions of the heater element 21 and rendering additional strength and rigidity to the bib 26 for ease of insertion between the wearer's outer garments and the skin of his posterior Cervical Plexus and for keeping the bib 26 in place. Also the heat diffusion or conducting material of the back portion of the bib 34 provides a protective cover between the skin of the wearer and the heater 21 for comfort of the wearer.

While the instant invention has been described with respect to a particular embodiment thereof it will be readily appreciated and understood that variations and modifications may be made without departing from the spirit or scope of the invention.

Having described our invention, what we claim as new, and desire to secure by Letters Patents is:

1. A low battery operated heating device comprising:

a fabric scarf having a length from a first end to a second end greater than its width from a first side to a center fold line when said scarf has been folded on itself along a center fold line running from a first end to a second end; to define a back portion and a front portion of substantially equal widths and lengths;

said scarf having an appendage in the form of a bib at right angles to the center fold line and midway between the first and second ends of the scarf;

said bib comprising a front portion and a back portion of substantially equal lengths and widths;

said front portion being constructed as an integral part of the scarf;

said back portion being constructed of a fabric capable of moisture absorbency and of diffusing heat, being attached to the scarf in such manner that when joined to said scarf it is of equal size and shape as the front portion of said bib;

a heater means disposed in said bib;

said heater means comprising a strip of electrical resistance material disposed in said bib of sufficient length and width so that said heater means completely covers a posterior Cervical Plexus when positioned next to a human body;

strips of heat diffusing material secured in back to back relationship for sandwiching said heater element therebetween; a means of disposing said heat diffusing material in said bib;

said means of disposing consisting of a resin-impregnated fabric by which heat diffusing material is secured;

a seam joining together said front and back portions of said bib and joining said back portion to said scarf;

said scarf having a sewn seam joining together said front portion and said back portion along a longitudinal edge opposite said center fold line and sewn seams joining said front and back portions at a first edge adjacent said first end and at second edge adjacent said end of said scarf;

a sewn seam joining together longitudinal edges and ends of said scarf; a means for supporting a low voltage battery within the folded portions of said scarf;

said means for supporting said battery comprising a single piece of flexible blank substantially rectangular in shape to define a back, a bottom, a front and a flap portion, said flap portion serving as a top covering of a pocket for receiving a battery;

said pocket being constructed by folding the front portion of said blank against the back portion of said blank so that the front portion is of a length at least equal to that of a low voltage battery and the back portion extends above the front portion to provide said covering flap;

a sewn seam securing longitudinal edges of said blank to form said pocket;

said pocket being open at a top edge to provide access to the pocket;

means for securing said pocket in the scarf in closed position when the battery is removed from the pocket and when the battery has been placed in said pocket; opposed electrical contacts connected to said pocket for engaging electrodes of a battery when said flap is closed on the pocket;

said opposed contacts including a connecting plate disposed in said pocket bottom;

a contact button connected to said flap of said pocket for an engaging electrode of a battery for electrical contact with said flap in closed position on said pocket;

means for securing said flap in closed position;

electrical conductors connecting each of said contacts in circuit with said resistance material and said electrical conductors extending between said back and front portions of said scarf from contacts on said pocket to contacts of said resistance material in said bib;

2. A low voltage, self-contained battery operated heating device comprising;

a fabric scarf blank being substantially rectangular in shape to define a back portion and a front portion of substantially equal lengths and widths which when folded along a longitudinal center fold line and joined together by a seam define a scarf;

said scarf having an appendage in the form of an elliptical shaped bib being part of and being secured to said scarf at right angles to a longitudinal center fold line and midway between a first end and an second end of said scarf;

said scarf having a sewn seam joining together said front portion and said back portion along a longitudinal edge opposite said center fold line and sewn seams joining said front and back portions at a first edge adjacent said first end and at a second edge adjacent said second end of said scarf;

said bib comprising a front portion and a back portion of substantially equal lengths and widths and being elliptical in shape;

said front portion being constructed of a fabric identical to and as an integral part of said scarf blank fabric;

said back portion constructed of an absorbent and heat-diffusing fabric attached to said scarf by a sewn seam in such manner that when joined to said scarf and to said front portion of said bib said back portion is of substantially equal size and shape as the front portion;

a heater means disposed in said bib only;

said heater means including a bare strip of electrical resistance material disposed in said bib;

said bare strip being of sufficient length and width so that said bare strip of electrical resistance material covers a posterior Cervical Plexus when said bib is positioned next to a human body;

a strip of heat-diffusing material having greater length and width than that of said bare strip of electrical resistance material;

said heat-diffusing strip being adhesively secured in back to back relationship for sandwiching said bare strip of resistance material therebetween in direct heat transfer relationship to define a heater assembly;

means of disposing said heater assembly in said bib and of maintaining said bib in direct contact with a wearer's posterior Cervical Plexus;

said means of disposing said assembly consisting of a resin-impregnated fabric substantially the same size and shape as said front and back portions of said bib to which said heater assembly is secured;

a seam joining said front portion of said bib to said resin impregnated fabric and to said back portion of said bib and joining said resin impregnated fabric and said back portion of said bib to said scarf;

means for supporting a low voltage battery within said scarf when said scarf blank has been folded together and seamed to define a scarf;

said supporting means comprising a blank of fabric substantially rectangular in shape to define a back, a bottom, a front and a flap portion of a pocket for receiving and containing a low voltage battery;

said pocket constructed by folding a front portion of said blank against a back portion of said blank so that said front portion will cover a low voltage battery and said back portion extends above said front portion to provide said flap;

a sewn seam securing said front portion of said blank to said back portion of said blank to form said pocket only;

a sewn seam securing said pocket to an inside surface of said back portion of said scarf;

said scarf being open along a segment of one longitudinal seam to provide access to said pocket;

means for securing said opening in said longitudinal seam when said battery has been placed in said pocket;

opposed electrical contacts connected to said pocket for engaging electrodes of a battery when said flap is closed on said pocket;

said opposed contacts including a conducting plate disposed in said bottom of said pocket;

a contact button connected to said flap of said pocket for engaging an electrode of said battery for electrical contact with said flap in closed position on said pocket only;

means for securing said flap in closed position for engaging the electrodes when said flap is in closed position only.

3. In combination with a fabric scarf blank folded along a longitudinal center fold line into a back portion and a front portion;

said portions having a longer dimension along said center fold line from a first end to a second end;

said portions having a shorter dimension from said center fold line across said scarf to an opposite edge;

a sewn seam being present in an edge at said first end, in said edge opposite said centerfold line and in an edge at said second end;

said sewn seam securing said back portion and said front portion of said scarf together;

a means for supporting a low voltage battery between said back portion and said front portion of said scarf;

a first pair of electrical contacts attached to said battery holding means;

a shaped bib comprising a front portion and a back portion of substantially equal lengths and widths;

said front portion being attached to said scarf at said scarf edge opposite from said center fold line at a point midway between first end and said second end of said scarf;

said bib having disposed between said front and back portions a resistance heating element;

said heating element being disposed at right angles to said center fold line of said scarf;

said heating element being covered by a heat-diffusing material;

a second pair of electrical contacts attached to said heating element;

electrical conductors attached to said electrical contacts in said bib and passing from said bib between said front and back portions of said scarf;

said electrical conductors attached to first pair of electrical contact means in said scarf.

4. The structure of claim 3 where the heat-diffusing material in the bib is a non-woven polyamide fabric and the battery holding means is formed from a blank of polyester fabric.

* * * * *